United States Patent [19]

Akira

[11] Patent Number: 4,952,281

[45] Date of Patent: Aug. 28, 1990

[54] SHEET CURLS REFORMER

[75] Inventor: Sakurabayashi Akira, Shizuoka, Japan

[73] Assignee: Kobayashi Engineering Works, Ltd., Shizuoka, Japan

[21] Appl. No.: 348,068

[22] Filed: May 5, 1989

[30] Foreign Application Priority Data

May 10, 1988 [JP] Japan ..... 63-111655
May 10, 1988 [JP] Japan ..... 63-111656

[51] Int. Cl.[5] ..... D21F 7/00; B65H 23/24

[52] U.S. Cl. ..... 162/270; 162/252; 162/197; 162/271; 493/459

[58] Field of Search ..... 162/197, 252, 270, 271; 493/459, 24

[56] References Cited

U.S. PATENT DOCUMENTS 4,539,072 9/1985 Frye et al. ..... 162/197

FOREIGN PATENT DOCUMENTS 48427 10/1985 Japan .

*Primary Examiner*—Karen M. Hastings
*Attorney, Agent, or Firm*—Koda & Androlia

[57] ABSTRACT

The present invention provides an apparatus for straightening sheet curls in which a wrap angle $\theta$ is provided for a sheet wound off from a winding roll by applying a decurler bar to the sheet between two backup rolls, the apparatus comprising a wrap angle adjusting device for adjusting the wrap angle of the sheet by relatively displacing the backup rolls and the decurler bar, and a controller which serves to calculate an optimum wrap angle in accordance with changes in the diameter of the winding roll using the logical equation: $\theta = A/D^q + B$ (wherein A, B, q are constants which are previously determined) from which the optimum wrap angle $\theta$ can be calculated for the diameter D of the winding roll, and to control the wrap angle adjusting device on the basis of the results of this calculation. In consequence, the present invention is able to realize automatization of straightening of curls with a simple configuration and in a rapid and highly precise manner.

2 Claims, 5 Drawing Sheets

SHEET CURLS REFORMER

BACKGROUND OF THE INVENTION

1. Field of the Invention

The present invention relates to an apparatus for straightening curls in a sheet made of a plastic film, paper, a metallic foil or the like which is wound off from a winding roll.

2. Description Of The Prior Art

For example, in an apparatus for cutting and treating a sheet, the sheet wound off from a winding roll is cut into given lengths by a cutting machine. At this time, if the sheet wound off from the winding roll is cut in that state, curls come into the open in the cut sheets due to a wound form. Such curls create problems such as jamming which may occur in a line for cutting and treating the sheets and in the sheet inlet portion of a printing machine or of various other machines when the sheets are thereafter introduced therein.

An apparatus for straightening curls in a sheet has previously been proposed in which a wrap angle is provided for a sheet wound off from a winding roll by applying a decurler bar to the sheet between two backup rolls, as described in Japanese Patent Publication No. 48427/1985.

The degree to which curls are straightened by the above-described apparatus for straightening sheet curls depends upon the wrap angle of the sheet, and the greater the wrap angle is, the stronger the pressure with which the sheet is wiped with the decurler bar and the greater the degree to which curls are straightened.

On the other hand, when a sheet is wound off from a winding roll, the extent to which curls are present in the sheet increases as the diameter of the winding roll decreases while winding-off progresses.

The use of the above-described apparatus for straightening sheet curls therefore requires monitoring of the change in the diameter of the winding roll and the provision of a wrap angle adjusting device which is capable of adjusting the relative position between the backup rolls and the decurler bar in such a manner that the wrap angle of the sheet is increased as the diameter of the winding roll decreases.

For example, such a wrap angle adjusting device is so configured that the decurler bar is displaced from a position corresponding to a large parent roll (the position where a low degree of pushing force is applied inwardly) to a position corresponding to a small parent roll (the position where a high degree of pushing force is applied inwardly ) in the state wherein the backup rolls are set at standard positions with the sheet pushed in.

In the apparatus for straightening sheet curls described in Japanese Patent Publication No. 48427/1985, an optimum degree of driving of the decurler bar for the purpose of straightening curls in correspondence with the change in diameter of the winding roll is expressed in a digital pattern using figures in order to automatically adjust the degree of straightening of the curls in the sheet in correspondence with the change in diameter of the winding roll. The figures are separately formed for respective kinds of sheet and the respective component items of the relevant straightening apparatus, each of the figures being formed by collecting in advance data with respect to the optimum degree of driving of the decurler bar from experiments which are performed in such a manner that the diameter of the winding roll is changed within a given range.

There has been an increasing demand in recent years for a hgh level of operational stability and a high level of productivity to be available in, for example, an apparatus for cutting and treating a sheet which is provided with an apparatus for straightening sheet curls, Improvements in the operating properties of such apparatus for cutting and treating sheets have not, however, been realized because the apparatus for straightening sheet curls represents a bottleneck. This is because of the problems described below which are not easily resolved, which are inherent to conventional control methods for controlling the driving of a decurler bar in the manner of a digital pattern, and which inhibit attempts to automate the straightening of curls from a simple arrangement in a rapid and highly precise manner.

(1) In order to increase the precision with which curls are straightened, it is necessary to set the driving of the decurler bar at an appropriate amount at each time the diameter of the winding roll slightly changes, resulting in the use of a large volume of data. The collection of data therefore requires a great number of processes.

2. Such data is previously determined for each kind of sheet and the component items of the straightening apparatus and are stored in the data storage memory so that data conforming to the relevant operation of straightening may be transmitted to the controller of the wrap angle adjusting device from the data storage memory and then used. During this operation, since, as described above, the volume of data is large, it is necessary to ensure that both the data storage memory and the controller have a space with a large memory capacity, and the further transmission of data from the data storage memory to the controller takes a great deal of time.

3. Since the operation of controlling the decurler bar using the wrap angle adjusting device is intermittently (stepwisely) performed in correspondence with the change in diameter of the winding roll, an optimum wrap angle cannot be set for the diameter of the winding roll each moment as it changes.

It is an object of the present invention to realize the automatization of straightening of curls with a simple arrangement and in a rapid and highly precise manner.

DISCLOSURE OF THE INVENTION

The present invention provides; an apparatus for straigthening sheet curls in which a wrap angle $\theta$ is provided for a sheet wound off from a winding roll by applying a decurler bar to the sheet between two backup rolls, characterized by comprising a wrap angle adjusting device for adjusting the wrap angle of the sheet by relatively changing both the backup rolls and the decurler bar, and a controller for controlling the wrap angle adjusting device on the basis of the results of calculation of an optimum wrap angle which is performed using the logical equation: $\theta = A/D^q + B$ (wherein A, B, q are constant which can be previously determined) from which the optimum angle $\theta$ for the diameter D of the winding roll can be calculated, in correspondence with the change in the diameter of the winding roll.

Furthermore, the present invention provides an apparatus for straightening sheet curls, wherein said constant q of the logical equation is 0.25 to 0.75.

Furthermore, the present invention provides an apparatus for straightening sheet curls, wherein said wrap angle adjusting device is so configured that a relationship ($S=K\theta$) is established between the amount S of relative displacement of the winding roll and decurler bar and the wrap angle $\theta$.

A description will now be given of on the basis for the achievement of the present invention.

(A) An apparatus for straightening curls is capable of straightening and reducing curls which are produced in a sheet on a winding roll. Consideration of such curls is given below.

As shown in FIG. 6, if the thickness of a sheet wound around a round bar (diameter, H) is t and the wrap angle is $\alpha$, the neutral line length $L_m$, the external peripheral length $L_o$ and the internal peripheral length $L_i$ of the wound sheet are as follows:

$$L_m=(H+t)\alpha/2 \quad (1)$$

$$L_o=(H+2t)\alpha/2 \quad (2)$$

$$L_i=H\alpha/2 \quad (3)$$

The difference $\Delta L$ in expansion of either the external periphery or the internal periphery relative to the neutral line is expressed by the following equation:

$$\Delta L=\pm t\alpha/2 \quad (4)$$

The strain $\epsilon$ of the sheet is expressed by the following equation:

$$\epsilon=\Delta L=\pm t/(H+t) \quad (5)$$

(B) From the above equation (5), the raw material strain $\epsilon$ 1 produced by a winding roll (diameter, D) which causes curls to occur is as follows:

$$\epsilon 1=\pm t/(D+t) \quad (6)$$

The straightening strain $\epsilon 2$ produced by a decurler bar (diameter, d) used for straightening curls is as follows:

$$\epsilon 2=\pm t/(d+t) \quad (7)$$

The ratio $\lambda$ between the raw material strain $\epsilon 1$ and the straightening strain $\epsilon 2$ is therefore as follows:

$$\lambda=\epsilon 1/\epsilon 2=(d+t)/(D+t) \quad (8)$$

According to an empirical rule based on the results of experiments conducted by the inventor, the following equation is established between the wrap angle $\theta$ and the ratio $\lambda$:

$$\theta=\lambda^q \quad (9)$$

In the above-described equation (9), since t is extremely small compared with D, t is able to be removed from the denominator of the equation (8) of $\lambda$, the numerator may be considered as a constant because the values of d and t are constant once the kind of sheet used and the component items of the straightening apparatus are determined. Thus the following equation is established.

$$\theta=A/D^q+B \quad (10)$$

In equation (10), B is a constant for increasing the degree to which curls are straightened, and also B may be zero, depending upon the given use.

(C) As a result of detailed consideration of the exponential coefficient q of equation (10), as described below, it has been confirmed that, if the value of q is selected from any value within the range of 0.25 to 0.75, an appropriate value of $\theta$ can always be provided in accordance with wide-ranging changes in the diameter D of the winding roll.

In other words, tests were conducted for equation (10) with values of q within the range of 0 to 2 using a decurler bar having a diameter of 12 mm$\phi$ and a sheet made of a white paper board with a basis weight of 270 to 450 g/m$^2$ at a sheet speed of 300 to 330 m/min (the maximum, 380 m/min) which is a normal speed.

The results of the tests are shown in FIG. 5 and are described below under (1) to (3). A suitable product after being subjected to straightening is preferably provided with a uniformly downward weak curl (angle curl). In the figure, curve a1 represents an allowable upper limit for downward curls (strong curls) and curve b1 represents an allowable lower limit for downward curls (weak curls), the range between curves a1 and b1 representing an appropriate region.

(1) When q=0.75, A=2685.2 and B=6.94, curve b2 was obtained. Curve b2 deviates from curve b1 in a region where the diameter of the roll is medium. In other words, with a value of q=0.75 or more, the wrap angle is excessively large (the effect of straightening is too great) when the diameter of the roll is small, as shown by curve b3, while, if the wrap angle is set to an appropriate value with the diameter of the roll being small, this angle is excessively small (the effect of straightening is too low) in a region where the diameter of the roll is medium, deivating from curve b1. Thus it is impossible to set the wrap angle to an appropriate value over the whole range of roll diameters. It is therefore suitable to determine the upper limit for practical use at q=0.75.

(2) When q=0.25, A=210.9 and B=−5.39, curve a2 was obtained. Curve a2 deviates from curve a1 within the range where the roll diameter is medium. In other words, with the value of q=0.25 or less, the wrap angle is excessively small (effect of straightening is too low) when the diameter of the roll is small, as shown by curve a3, while, if the wrap angle is set to an appropriate value with the diameter of the roll being small, this angle is excessively large (effect of straightening is too great) within the range where the roll diameter is medium, deviating from curve a1. Thus it is impossible to set the wrap angle to an appropriate value over the whole range of roll diameters. It is therefore suitable to determine the lower limit for practical use of q=0.25.

(3) When q=0.5, A=648.2 and B=11.6, a curve which coincides with curve a1 was obtained. When q=0.5, A=716.8 and B=0, a curve which coincides with curve a1 was obtained. A very good effect of straightening curls can thus be obtained over the whole range of roll diameters by setting q at 0.5.

As a result of conducting tests in which q in equation (10) was set within the range of 0.25 to 0.75 (preferably 0.5) and A and B were set at the above-described values, it was found that the equation can be satisfactorily applied in practical use without the values of A and B needing to be changed, regardless of the change in thickness (t=0.35 to 0.58 mm, rate of change, 166%) of sheets with a basis weight within the range of 270 to 450 g/m$^2$. In other words, since the values of A and B may be set for each group of certain types of sheet (material and thickness), only a small number of data needs to be stored as the constants A, B.

(D) The wrap angle adjusting device of the present invention is preferably so configured that the relationship:

$$S=k\theta \quad (11)$$

is established between a relative displacement S between the backup rolls and the decurler bar and the wrap angle $\theta$. In an example of such a configuration, the locus of relative movement of the decurler bar is set on a perpendicular bisector of the straight line connecting the two backup rolls. If the controller is operated using equation (11), the value S can be easily calculated using the value $\theta$ which is calculated from equation (10), resulting in an improved facility of calculation.

The present invention achieved on the basis of the items (A) to (D) exhibits the following effects:

(1) Since the constants to be prepared for each type of sheet and each component item of the straightening apparatus are the three constants A, B and q (if q is fixed within the range of 0.25 to 0.75, preferably 0.5, the two constants A, B), only a small number of data needs to be collected or stored.

(2) The data on the above-described constants are determined in advance for each type of sheet and each component item of the straightening apparatus and stored in the data storage memory, and data appropriate to the relevant work of straightening are transmitted to the controller in the wrap angle adjusting device from the data storage unit and then used therein. Thus, since the quantity of data is small, as described above, only a small space with a memory capacity of either the data storage unit or the controller is needed. The time required for transmitting the data to the controller from the data storage memory can thus be reduced to a negligible value.

(3) Since the control is performed in a completely continuous manner in accordance with the changes in diameter of the winding roll as the time taken for arithmetic processing using the equations is, for example, several tens of milliseconds, an appropriate wrap angle can be set for the diameter of the winding roll each moment as it changes. It is therefore possible to precisely control the state of the sheet which is conveyed at a high speed and to provide such additional merits as the stability of operations conducted at high speeds, a reduction in the quantity of paper powder and an improvement in the appearance of sheets placed in layers.

DETAILED DESCRIPTION OF THE PREFERRED EMBODIMENTS

Figure 1:
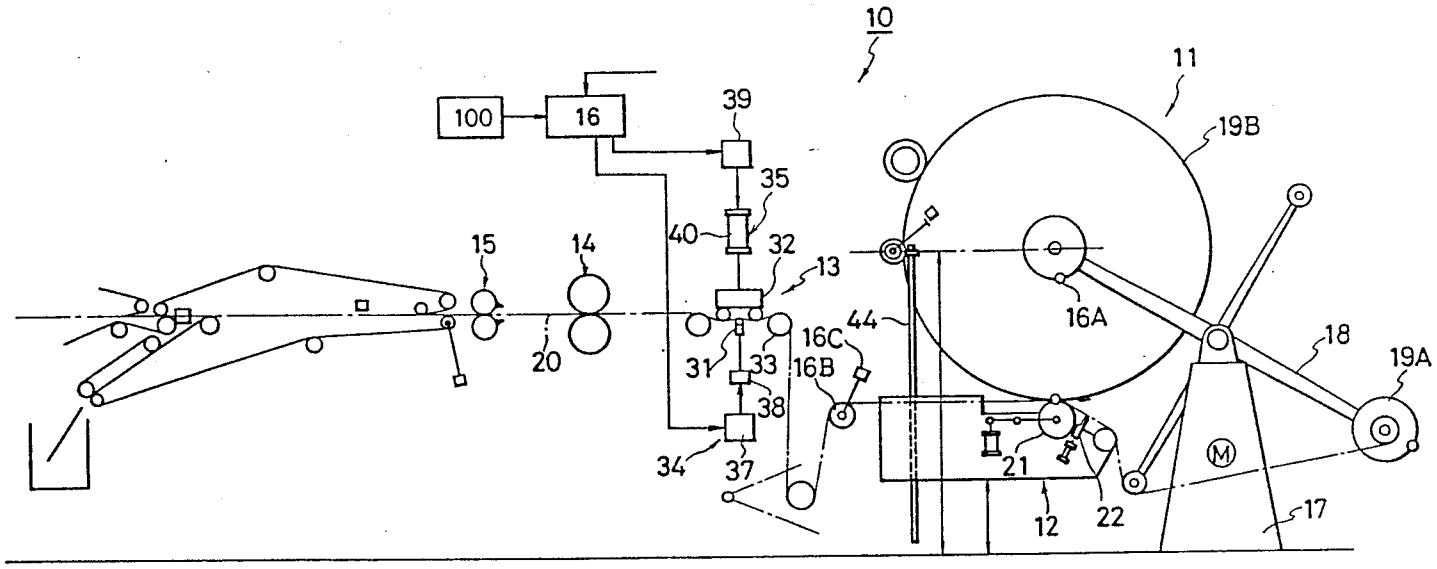
FIG. 1 is a schematic diagram of an example of a sheet cutting and treating apparatus to which the present invention is applied.

A sheet cutting and treating apparatus 10 comprises a sheet feeder 11, a sheet splicing apparatus 12, a curl straightening apparatus 13, a feed roll 14, a cutting machine 15, and a controller 16.

The sheet feeder 11 has a turning arm 18 which is supported by a frame 17 and which has both ends respectively supporting parent rolls 19 (a first parent roll 19A and a second parent roll 19B) to supply a sheet 20 from each of the parent rolls 19.

The sheet splicing apparatus 12 comprises a pressure roller 21 and a knife 22, (1) the pressure roller 21 functioning to press the portion at the rear end of the sheet supplied from the first parent roll 19A against the adhesive double coated tape which was applied to the portion at the front end of the sheet supplied from the second parent roll 19B, and (2) the knife 22 functioning to cut off the sheet supplied from the first parent roll 19A at the rear end thereof which is adjacent to the splicing portion.

The curl straightening apparatus 13 serves to straighten curls produced in the sheet 20 in correspondence with the change in the diameter D of each of the parent rolls 19, as described below.

The feed roll 14 functions to provide the sheet 20 with a tension required for winding out the sheet 20 from each of the parent rolls 19.

The cuttin machine 15 functions to cut the sheet 20 which is straightened while being continuously carried in the curl straightening apparatus 13 into an appropriate length.

The controller 16 functions to control each of the sheet feeder 11, the sheet splicing apparatus 12, the curl straightening apparatus 13, the feed roll 14 and the cutting machine 15.

The controller 16 is able to count the rotational speed N1 of the first parent roll 19A using a parent roll rotation detector 16A provided on the turning arm 18 in order to observe any change of the diameter D of the first parent roll 19A, as well as counting the rotational speed N2 of an intermediate roll 16B (having a known diameter E) using a rotation detector 16C provided for the intermediate roll 16B. The controller 16 is also able to always perform a calculation of $D=E(N2/N1)$ in CPU using the relationship: sheet speed $V=\pi DN1=\pi EN2$, to obtain the diameter D of the first parent roll 19A.

When the diameter D of the first parent roll 19A is reduced to a diameter F which is preparatory to exchange, the controller 16 causes the turning arm 18 of the sheet feeder 11 to be turned so as to place the first parent roll 19A at the position shown in FIG. 1 at which the work of splicing is effected, and then drives the sheet splicing apparatus 12 which thus performs the splicing of the sheets respectively supplied from the first parent roll 19A and the second parent roll 19B in the manner described above.

A description will now be given of a typical configuration of the curl straightening apparatus 13.

The curl straightening apparatus 13 comprises a decurler bar 31, two main backup rolls 32 which are provided on both sides of the decurler bar 31, two secondary backup rolls 33 which are provided on both outer sides of each of the main backup rolls 32, a wrap angle adjusting device 34 for driving the decurler bar 31, and an apparatus 35 for changing suddenly the wrap angle which serves to drive the main backup rolls 32.

In other words, the curl straightening apparatus 13 serves to straighten curls produced in the sheet 20 by applying the decurler bar 31 to the sheet 20 wound out from each of the parent rolls 19 between the two main backup rolls 32 so as to provide a wrap angle $\theta$ for the sheet 20.

(a) The wrap angle adjusting device 34 drives the decurler bar 31 using, for example, a screw-type feeder 38 which is operated a driving portion 37 controlled by the controller 16. The decurler bar 31 longitudinally displaced along the perpendicular bisector of the line connecting the right and left main backup rolls 32.

Figure 2:
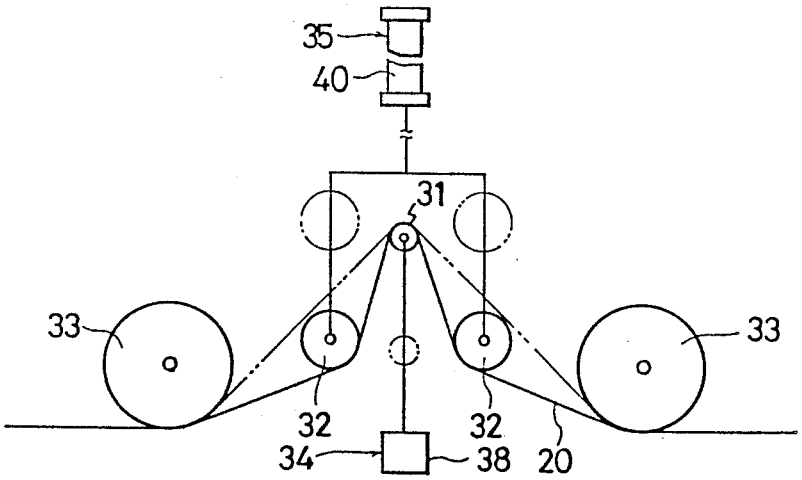
FIG. 2 is a schematic diagram of an embodiment of an apparatus for straightening curls.
Figure 3:
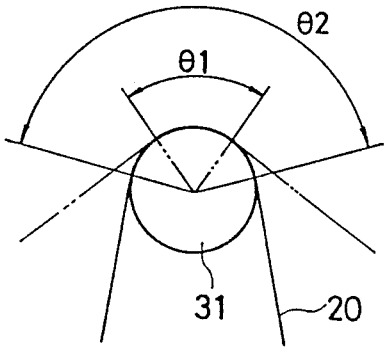
FIG. 3 is a schematic diagram which shows the change in wrap angle of a sheet.

Namely, the wrap angle adjusting device 34 controlled by the controller 16 causes (1) the decurler bar 31 to be displaced from the position (position shown by the two-dot chain lines in FIG. 2) corresponding to a large parent roll in correspondence with the change in diameter of each of the parent rolls 19 to the position (position shown by the solid lines in FIG. 2) corresponding to a small parent roll in the state wherein the main backup rolls 32 are set at the standard positions (positions shown by the solid lines in FIG. 2) at which the sheet is pushed inwardly. As a result, the wrap angle $\theta$ of the sheet 20 is adjusted between a small angle $\theta 1$ corresponding to the large parent roll and a large angle $\theta 2$ corresponding to the small parent roll (refer to FIG. 3). During this adjustment, the controller 16 performs the successive determination of the wrap angle $\theta$ (or the amount of displacement S of the decurler bar 31) which is optimum for straightening of curls using the logical equation described below in correspondence with the change in diameter of each of the parent rolls 19. The controller 16 also controls the driving portion 37 in such a manner that an optimum wrap angle $\theta$ (or an optimum displacement S of the decurler bar 31) calculated as described above is achieved in correspondence with the change of the diameter D.

The controller 16 utilizes the logical equation ($\theta = A/D^q + B$ or $S = K\theta$ for calculating the optimum wrap angle $\theta$ (or the displacement S of the decurler bar 31) in correspondence with the change in diameter D of the winding roll, as described above. The data on the constants A, B and q are determined in advance for each kind of the sheet 20 and each component item of the straigthening apparatus and stored in the data storage memory 100. The data for the constants A, B, q which are appropriate to the relevant operation of straightening are then supplied from the data storage memory 100 to the controller 16. The value of q is preferably 0.25 to 0.75, more particularly 0.5.

The wrap angle adjusting device 34 which is controlled by the controller 16 operates to (2) return the decurler bar 31 to the position corresponding to the large parent roll from the small parent roll when the controller 16 controls the sheet splicing apparatus 12 in such a manner that the sheet from the first parent roll 19A is connected to the sheet from the second parent roll 19B, as described above.

(b) The apparatus 35 for suddenly changing the wrap angle drives the main backup rolls 32 using, for example, a cylinder 40 which is operated by the driving portion 39 controlled by the controller 16.

In other words, the apparatus 35 for suddenly changing the wrap angle controlled by the controller 16 causes the main backup rolls 32 to retract from the standard positions at which the sheet is pushed inwardly to the position at which the sheet is not pushed inwardly (or moderately pushing inwardly) so as to suddenly change the wrap angle $\theta$ of the sheet 20 substantially at the same timing as the controller 16 controls the wrap angle adjusting device 34 to start the return of the decurler bar 31 from the position corresponding to the small parent roll to the position corresponding to the large parent roll.

(c) The secondary backup rolls 33 are stationarily provided on both outer sides of the decurler bar 31 and the main backup rolls 32, as described above, and serve to guide the sheet 20 in such a manner that the wrap angle $\theta$ of the sheet 20 is a value ($\theta 1$) suitable for the diameter of the first parent roll 19B having a large diameter, when the apparatus 35 for suddenly changing the wrap angle causes the main backup rolls 32 to retract from the positions at which the sheet is pushed inwardly.

A description will now be given of the function of the above-described emdodiment.

Figure 4A:
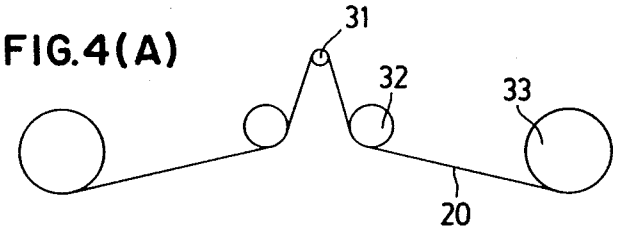
FIGS. 4A–F are a schematic diagram of the operation of an apparatus for straightening sheet curls.

The curl straigthening apparatus 13 operates in the following manner:

(A) When the sheet is wound off from the identical parent roll 19, the wrap angle adjusting device 34 functions to displace the decurler bar 31 from the position corresponding to the large parent roll to the position corresponding to the small parent roll in correspondence with the change in diameter of the parent roll in the state wherein the main backup rolls 32 are set at the standard positions at which the sheet is pushed inwardly, so that, the wrap angle $\theta$ of the sheet 20 is set to an appropriate value for the diameter D of the parent roll used, resulting in appropriate straighetning of curls (see FIG. 4(A)).

(B) The sheets from the first and second parent rolls 19A, 19B are spliced to each other by the sheet splicing apparatus 12 in the following processes (1) to (4):

(1) The wrap angle adjusting device 34 starts the return of the decurler bar 31 from the position corresponding to the small parent roll to the position corresponding to the large parent roll.

Figure 4B:
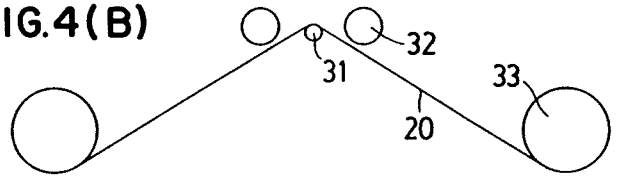

(2) The apparatus 35 for suddenly changing the wrap angle causes the main backup rolls 32 to retract from the standard positions at which the sheet is pushed inwardly to the position at which the sheet is not pushed in (or moderately pushed in) so as to suddenly change the wrap angle $\theta$ of the sheet 20 substantially at the same time as the above-described process (1 ) of starting the return. During this operation, the sheet 20 is guided by the secondary backup rolls 33, and the wrap angle $\theta$ of the sheet 20 is set to a value appropriate to the diameter of the second parent roll having a large diameter in a moment. As a result, the curls in the sheet 20 wound off from the second parent roll 19B having a large diameter are appropriately straightened (refer to FIG. 4(B)).

Since it is sufficient that the apparatus 35 for suddenly changing the wrap angle simply functions to selectively switch the two positions of the main backup rolls 32, i.e., the standard positions at which the sheet is pushed inwardly and the positions at which the main backup rolls are retracted, the operation of switching can be easily completed in a moment.

Figure 4C:
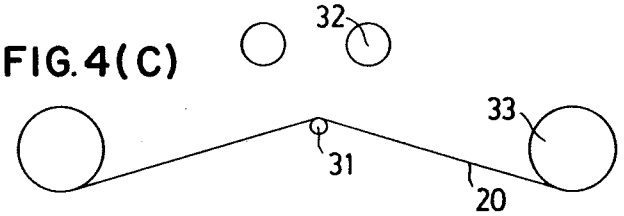

(3) The decurler bar 31 is completely returned to the position corresponding to the large parent roll by the wrap angle adjusting device 34 (refer to FIG. 4(C)).

Figure 4D:
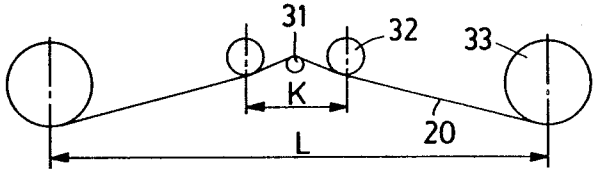

(4) The main backup rolls 32 are reset to the standard positions at which the sheet is pushed inwardly from the positions at which the main backup rolls are retracted by the apparatus 35 for suddenly changing the wrap angle (refer to FIG. 4(D)).

Figure 4E:
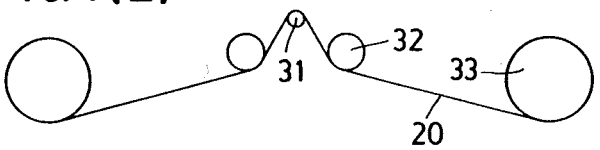
Figure 4F:
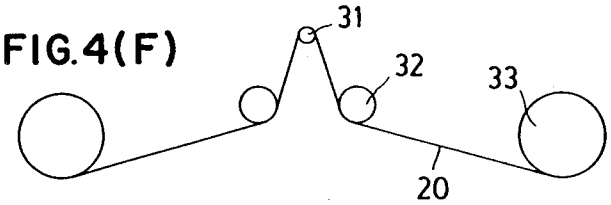
Figure 5:
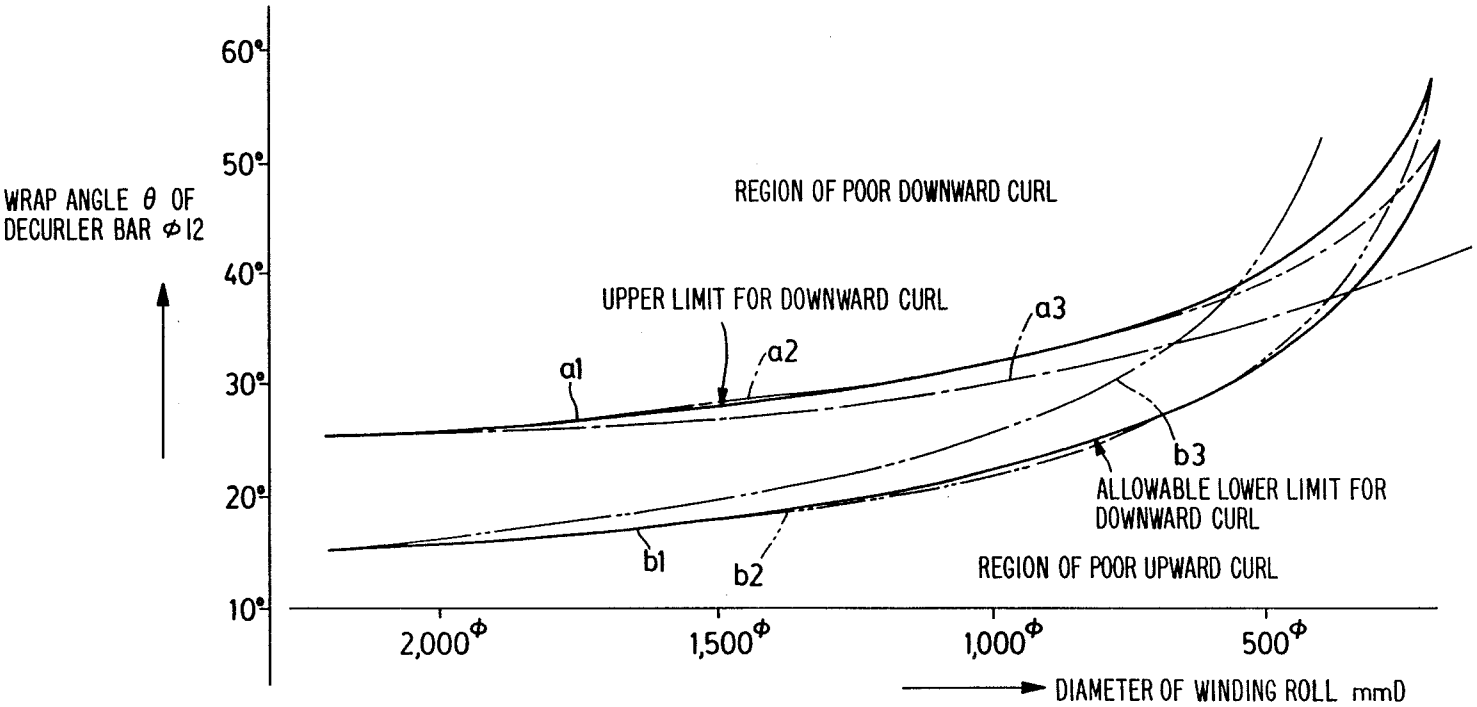
FIG. 5 is a figure of lines which shows the results of an example of tests conducted using the logical equations of the present invention.
Figure 6:
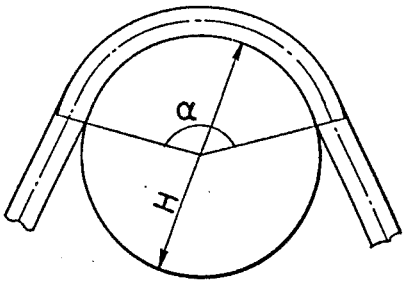
FIG. 6 is a schematic diagram of the mechanism of occurrence of curls in a sheet.

(C) The wrap angle adjusting device 34 functions to displace the decurler bar 31 from the position corresponding to the large parent roll to the position corresponding to the small parent roll in correspondence with the reduction in diameter D of the second parent roll 19B in the same manner as that described (A). The wrap angle of the sheet is therefore set to a value optimum for the parent roll used, resulting in appropriate straigthening of curls (refer to FIGS. 4(E)) and 4(F)).

The above-described embodiment therefore enables the wrap angle of the sheet 20 to be changed in a moment in accordance with the changes in the diameter of the parent roll used in the state wherein the line speed of the sheet cutting and treating apparatus 10 is kept at a high value which is determined by, for example, the capacity of the cutting machine 15, when the first and second parent rolls are changed over as above described in (B). The curls in the sheet 20 can be appropriately and precisely straightened, while the productivity of the line being maintained.

In FIG. 4, (A) and (F) each represent the case where the diameter of the parent roll 19 used is minimum, the decurler bar 31 is placed at the position corresponding to the small parent roll, and the wrap angle $\theta$ of the sheet 20 is the maximum value $\theta 2$. (C) represents the case where the diameter of the parent roll 19 used is maximum, the decurler bar 31 is placed at the position corresponding to the large parent roll, and the wrap angle $\theta$ of the sheet 20 is the minimum value $\theta 1$.

In FIG. 4, although the wrap angle $\theta$ of the sheet 20 slightly changes as the state of the sheet 20 changes from (B) to (D), such a change in the wrap angle $\theta$ is reduced to be negligible for practical use if the distance K between the main backup rolls 32 is sufficiently smaller than the distance L between the secondary backup rolls 33.

Since the above-described equations are used for calculating $\theta$ and S in the controller 16, the above-described embodiment also has the following functions:

(1) Since the constants prepared for each type of sheet and each component item of the straightening apparatus are the three constants A, B q (if the q value is fixed to 0.25 to 0.75, preferably 0.5, the two constants A, B), only a small number of data to be collected or stored is sufficient.

(2) The data for the above-described constants are previously determined for each type of sheet and each component item of the straightening apparatus and stored in the data storage memeory, data appropriate to the relevant operation of straightening are transmitted from the data storage memory to the controller of the wrap angle adjusting device and used therein. Since the amount of data is small, as described above, only a small space with a memory capacity of either the data storage unit or the controller is needed. The time required for transmitting the data to the controller from the data storage memory can thus be reduced to a negligible value.

(3) Since the speed of calculation using the logical equation s is , for example, several tens of milliseconds, and the control can be performed in a complete continuous manner in correspondence with the change in diameter of the winding roll used, an optimum wrap angle can be set for each diameter of each winding roll. It is therefore possible to precisely control the state of the sheet carried at a high speed and provide additional merits such as the stability of the operation at a high speed and a reduction in amount of paper dust, as well as an improvement in the appearance of sheets placed in layers.

In an application of the present invention, the wrap angle adjusting device may adjust the wrap angle by controlling the displacement of the main backup rolls in accordance with the changes in the diameter of each winding roll in place of the control of the displacement of the decurler bar. In this case, the apparatus for suddently changing the wrap angle switches in a moment the decurler bar between the standard position at which the sheet is pushed inwardly and the position at which the decurler bar is retracted.

In the present invention, the wrap angle adjusting device may function to displace one of the main backup rolls and the decurler bar along a straight line relative to the other, as well as displacing it along a curve line by an operation of turning.

As described above, the present invention is capable of realizing automatization of straightening of curls with a simple configuration and in a rapid and highly precise manner.

What is claimed is:

1. An apparatus for straigthening sheet curls in which a wrap angle $\theta$ is provided for a sheet wound off from a winding roll having a changing diameter D as the sheet is wound off from it comprising a decurler bar which is applied to said sheet and is located between two backup rolls, a wrap angle adjusting device for adjusting said wrap angle of said sheet by relatively changing the position of both said backup rolls and said decurler bar, and a controller means for controlling said wrap angle adjusting device, means for continuously detecting the diameter D of said winding roll, and means for calculating an optimum wrap angle using the logical equation: $\theta = A/D^q + B$, wherein A, B are constants which are previously determined based on the type of sheet to be decurled, q is a constant which is previously determined based on the type of sheet to be decurled, D is the diameter of said winding roll, from which said optimum angle $\theta$ for the diameter D of said winding roll can be calculated, in correspondence with the change in said diameter of said winding roll, and said controller means being structured and arranged to control said wrap angle based on said detection means and said calculation means.

2. An apparatus for straightening sheet curls according to claim 1, wherein said constant q of said logical equation is 0.25 to 0.75.

* * * * *